United States Patent [19]

Bares

[11] Patent Number: 4,707,115

[45] Date of Patent: Nov. 17, 1987

[54] DEVICE FOR CLEANING A CHARGING MEMBER

[75] Inventor: Jan Bares, Webster, N.Y.

[73] Assignee: Xerox Corporation, Stamford, Conn.

[21] Appl. No.: 901,493

[22] Filed: Aug. 28, 1986

[51] Int. Cl.[4] ..... G03G 21/00

[52] U.S. Cl. ..... 355/15; 15/256.51; 355/3 DD

[58] Field of Search ..... 355/3 R, 3 DD, 15; 15/256.51, 256.52

[56] References Cited

U.S. PATENT DOCUMENTS

| | | | |
|---|---|---|---|
| 3,740,789 | 5/1973 | Yamamoto | 15/256.63 |
| 3,986,227 | 10/1976 | Fathergill et al. | 355/15 X |
| 4,285,090 | 8/1981 | Jurkowski | 355/15 X |
| 4,339,195 | 7/1982 | Gabelman | 355/15 X |
| 4,462,682 | 7/1984 | Monma | 355/15 |
| 4,521,098 | 6/1985 | Hosoya et al. | 355/3 DD |
| 4,624,545 | 11/1986 | Yasuda et al. | 355/3 DD |

FOREIGN PATENT DOCUMENTS

| | | |
|---|---|---|
| 57-70576 | 5/1982 | Japan . |
| 57-93370 | 6/1982 | Japan . |
| 59-109080 | 6/1984 | Japan . |

*Primary Examiner*—Fred L. Braun

*Attorney, Agent, or Firm*—H. Fleischer; J. E. Beck; R. Zibelli

[57] ABSTRACT

An apparatus in which a latent image is developed with marking particles. The marking particles are transported to the latent image. As the marking particles are being moved to the latent image, they are electrically charged by a plate in contact with the transport. The plate, charging the marking particles, is periodically cleaned to remove particles adhering thereto.

8 Claims, 5 Drawing Figures

DEVICE FOR CLEANING A CHARGING MEMBER

This invention relates generally to an electrophotograhic printing machine, and more particularly concerns a development apparatus employed therein.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated area. This records an electrostatic latent image on the photoconductive member corresponding to the informational areas contained within the original document being reproduced. After the electrostatic latent image is recorded on the photoconductive member, the latent image is developed by bringing marking particles into contact therewith. This forms a powder image on the photoconductive member which is subsequently transferred to a copy sheet. The copy sheet is heated to permanently affix the marking particles thereto in image configuration.

Various types of development system have hereinbefore been employed. These systems utilize two component developer material or single component developer material. Two component developer material includes toner particles adhering triboelectrically to carrier granules. A single component development system uses only toner particles. In many of the single component development systems, the toner particles are conductive. However, the transfer of conductive toner particles to the copy sheet is usually inefficient. In order to overcome this problem, insulating toner particles are frequently employed. When insulating toner particles are utilized, it is necessary to charge these toner particles to the correct polarity. This may be achieved by employing a flexible blade in contact with a doner roller. As the doner roller transports the toner particles toward the latent image recorded on the photoconductive member, the toner particles pass through a nip defined by the flexible blade and the roll. The toner particles passing through this nip are triboelectrically charged. Furthermore, this nip defines the quantity of toner particles being transported on a roller to the latent image recorded on the photoconductive member. It has been found that particles remain adhering to the charging blade. These particles produces streaks on the copy sheet. Thus, it is thus highly desirable to remove the particles adhering to the charging blade so as to improve copy quality. Various techniques have hereinbefore been employed to clean blades. The following disclosures appear to be relevant:

U.S. Pat. No. 3,740,789
Patentee: Ticknor
Issued: June 26, 1973

Japanese Patent Publication No. 57-70576
Applicant: Yamamoto
Published: May 1, 1982

Japanese Patent Publication No. 57-93370
Applicant: Kitahara
Published: June 10, 1982

Japanese Patent Publication No. 59-109080
Applicant: Ichikawa
Published: June 23, 1984

The relevant portions of the foregoing disclosures may be briefly summarized as follows:

Ticknor discloses an oscillating cleaning blade and drive mechanism to clean a photoconductive surface. The blade is supported on a carriage which is incrementally moved along a path to clean the photoconductive member. This reduces the possibility of foreign matter being entrapped between the blade and the photoconductive member.

Yamamoto describes a cleaning device which cleans a filter through the use of a freely slidable blade. The device is operated manually by pushing a rod which is connected to a sliding body with the blade mounted thereon.

Kitahara discloses a cleaning member located between a photoconductive member and a development vessel. Foreign matter is removed by manually sliding the cleaning member from the outside of the unit.

Ichikawa describes a cleaning device which removes foreign matter from the edge of the blade. The blade contacts a brush when it is spaced from a photoconductive member. The brush is substantially equal in length to the total length of the blade.

Pursuant to the features of the present invention, there is provided an apparatus for developing a latent image with marking particles. The apparatus includes means for transporting the marking particles to the latent image. Means are provided for electrically charging the marking particles being moved to the latent image by the transporting means. Means periodically clean the charging means to remove particles adhering thereto.

In accordance with another aspect of the present invention, there is provied an electrophotographic printing machine of the type having an electrostatic latent image recorded on a photoconductive member. The latent image is developed with insulating toner particles to form a toner powder image thereon that is transferred to a copy sheet. The toner powder is permanently fused to the copy sheet to form a copy of an original document being reproduced. The improvement in the printing machine includes means for transporting the toner particles to the latent image. Means are provided for electrically charging the toner particles being moved to the latent image by the transporting means. Means periodically clean the charging means to remove particles adhearing thereto.

Other aspects of the present invention will become apparent as the following description proceeds and upon reference to the drawings, in which.

Figure 1:
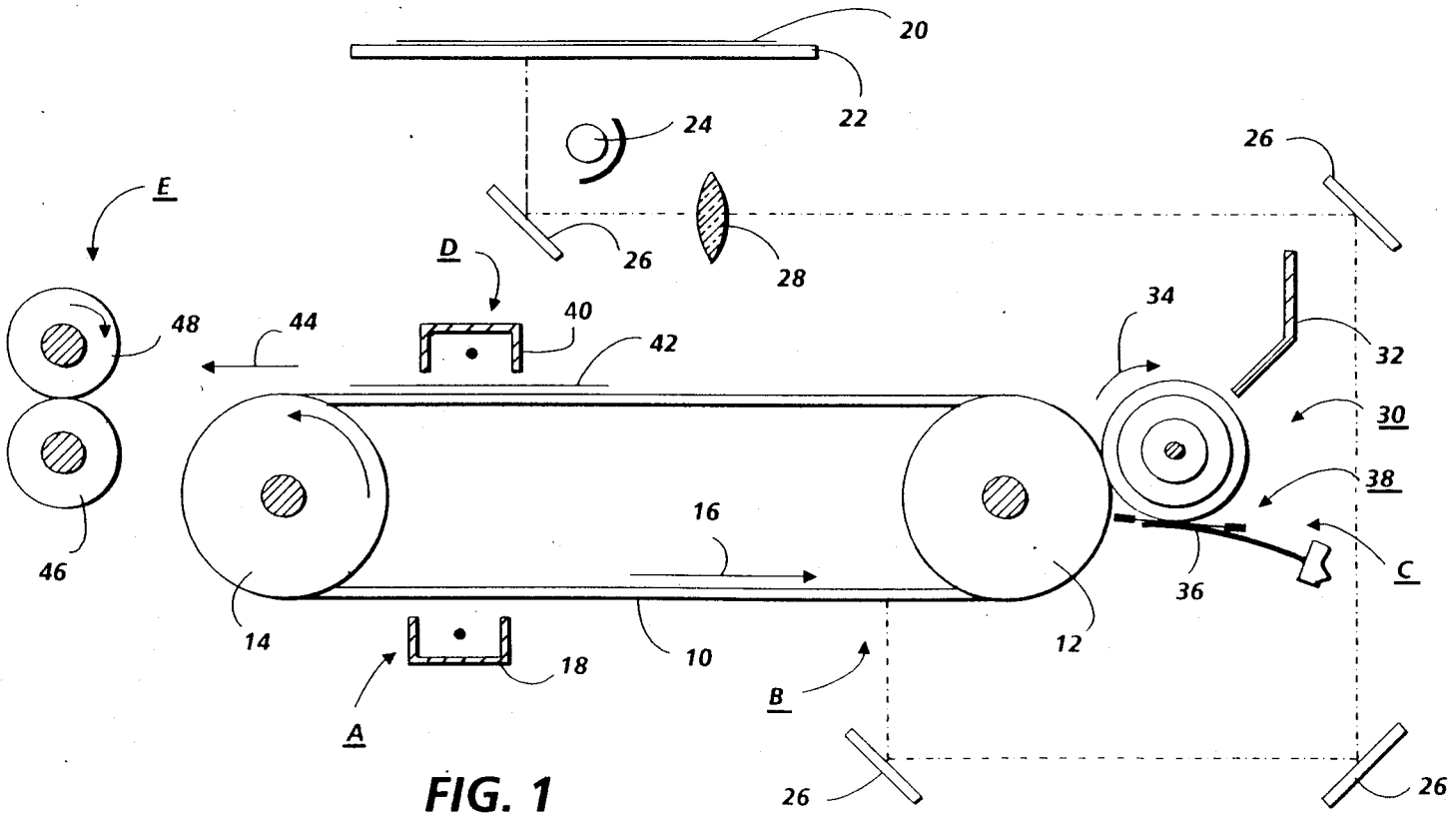
FIG. 1 is a schematic elevational view depicting an electrophotgraphic printing machine incorporating the development apparatus having the cleaning device of the present invention therein.

While the present invention will hereinafter be described in connection with various embodiments thereof, it will be understood that it is not intended to limit the invention to these embodiments. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to identify identical elements.

FIG. 1 schematically depicts the various components of an illustrative electrophotographic printing machine having the development apparatus incorporating the cleaning device of the present invention therein. It will become evident from the following discussion that the development apparatus with the cleaning device of the present inventon is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface deposited on a conductive substrate. Preferably, the photoconductive surface is made from a selenium alloy with the conductive substate being made from an aluminum alloy. Other suitable photoconductive materials and conductive substrates may also be employed. Belt 10 is entrained about a pair of opposed, spaced rollers 12 and 14. Roller 14 is rotated by a motor coupled thereto by suitable means such as a drive belt. As roller 14 rotates, belt 10 advances the photoconductive surface, in the direction of arrow 16, through the various processing stations disposed about the path of movement thereof.

Initially, the photoconductive surface passes through charging station A. At charging station A, a corona generating device 18 charges the photoconductive surface to a relatively high, substantially uniform potential.

Next, the charged portion of the photoconductive surface is advanced through imaging station B. At imaging station B, an original document 20 is positioned face down upon a transparent platen 22. Imaging of document 20 on platen 22 is achieved by an exposure system which includes a lamp 24, mirror 26, and moving lens 28. The exposure system is a moving optical system. The lamps, mirrors and lens move across the orignal document illuminating incremental widths thereof to form a light image. The light image is projected onto the charged portion of the photoconductive surface. The charged photoconductive surface is selectively discharged by the light image to record an electrostatic latent image of the original document thereon. Thereafter, belt 10 advances the electrostatic, latent image recorded on the photoconductive surface to development station C.

At development station C, a donor roller, indicated generally by the reference numeral 30, receives insulating, non-magnetic toner particles from a toner particle supply reservoir 32. As donor roller 30 rotates, in the direction of arrow 34, toner particles are advanced therewith through a nip defined by a flexible blade or palte having the region of the free end thereof in contact therewith. As the toner particles pass through the nip defined by the flexible plate contacting donor roller 30, the toner particles are charged thereon. These charged toner particles are then transported by donor roller 30 to the electrostatic latent image recorded on the photoconductive surface of belt 10. The electrostatic latent image attracts the toner particles from donor roller 30 to form a powder image thereon. In addition to charging the toner particles adhering to donor roller 30, blade 36 meters the quantity of toner particles being advanced to the electrostatic latent image. As shown, one end of blade 36 is mounted fixedly with the free end region thereof being pressed into contact against the exterior circumferential surface of donor roller 30. Blade 36 is flexible. A cleaning device, indicated generally by the reference numeral 38, is periodically actuated. The cleaning device is adapted to remove residual particles adhering to blade 36 in the region of the nip. Thus, any particles adhering to blade 36 in the nip defined as the contact region between donor roller 30 and blade 36 are removed therefrom. Cleaning device 38 is periodically actuated, i.e. after a preselected number of copies have been reproduced in the electrophotographic printing machine. For example, the cleaning device may be actuated after every two thousand copies. At other times, the cleaning device is spaced from the nip so as to not interfere with the charging and metering function of blade 36. Further details of the development apparatus and the cleaning device will be described hereinafter with reference to FIGS. 2 through 5, inclusive.

With continued reference to FIG. 1, after the electrostatic latent image is developed with toner particles, belt 10 advances the toner powder image to transfer station D. At transfer station D, a corona generating device sprays ions onto the backside of copy sheet 42 positioned thereat. This attracts the toner powder image from the photoconductive surface of belt 10 to copy sheet 14. After transfer of the toner powder image to copy sheet 42, copy sheet 42 advances, in the direction of arrow 44, through fusing station E.

Fusing station E includes a heated fuser roller 46 and a back-up roller 48. The toner powder image on copy sheet 42 contacts fuser roller 46. In this manner, the powder image is permanently affixed to copy sheet 42. After fusing, copy sheet 42 is advanced by forwarding rollers through a chute to a catch tray where the operator removes the completed copy.

Figure 2:
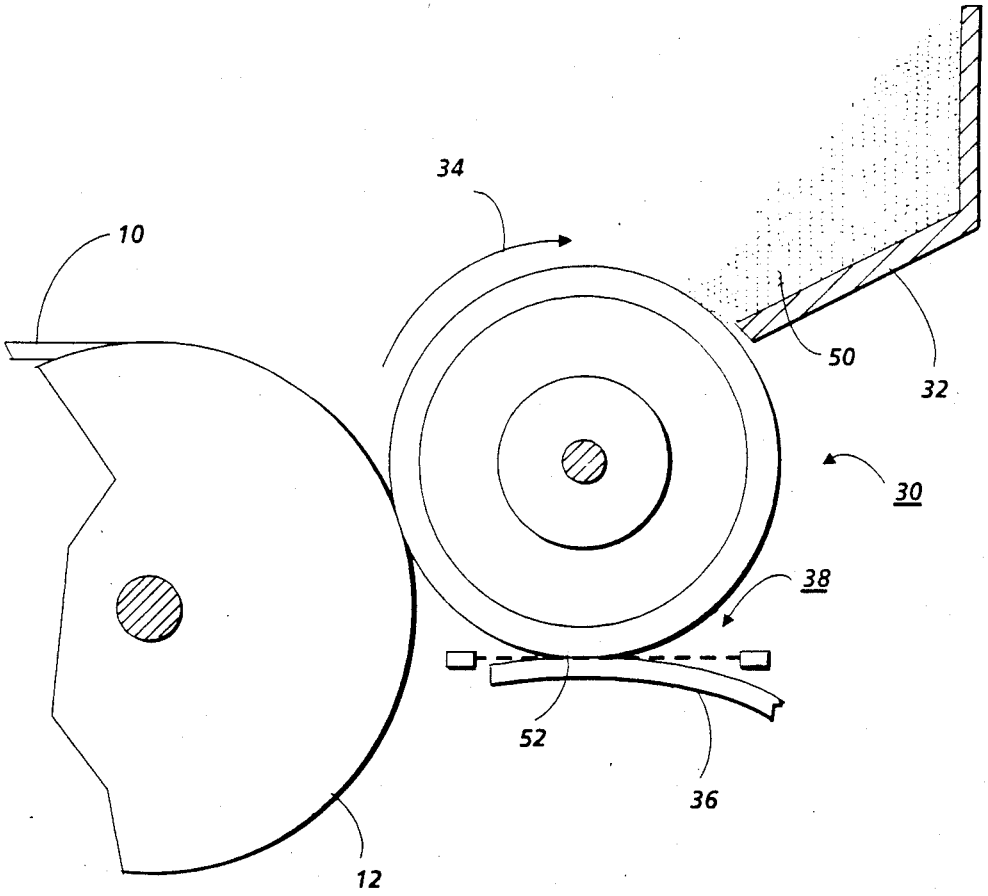
FIG. 2 is a schematic elevational view showing the development apparatus with the cleaning device therein as used in the FIG. 1 printing machine.

Referring now to FIG. 2, the detailed structure of the development apparatus having the cleaning device incorporated therein is shown thereat. The development apparatus includes a donor roller, indicated generally by the reference numeral 30. Donor roller 30 has a fluoropolymer coating thereon. The coating covers the entire circumferential surface thereof. Generally, the coating has a thickness ranging from about 2 micrometers to about 125 micrometers and preferably ranges from about 10 micrometers to about 50 micrometers. Donor roller 30 may be made from any suitable material including, for example, aluminized Mylar coated with the fluoropolymer coating, a seamless extruded polymer sleeve coated with a polymer containing a conductive additive such as carbon black and overcoated with a fluoropolymer, or a bare electroformed nickel sleeve having a fluoropolymer coating thereover. Toner supply reservoir 32 has a supply of toner particles 50 therein. The supply of toner particles 50 in reservoir 32 are weakly charged particles. Flexible plate or blade 36 has the free end region 52 thereof contacting the surface of donor roller 30 to define a nip therebetween through which the particles adhering to donor roller 30 pass. In this way, as donor roller 30 rotates in the direction of arrow 34, toner particles 50 are advanced through nip 52. As the toner particles pass through nip 52, the quantity of toner particles is regulated and the toner particles remaining adhering to donor roller 30 are triboelectrically charged. By way of example, blade 36 may be made from a strip of flexible steel. Donor roller 30 is electrically biased to a suitable magnitude and polarity so that the toner particles adhering thereto are electrostatically attracted to the latent image recorded on the photoconductive surface of belt 10. As shown, the cleaning device, indicated generally by the reference numeral 38, is positioned so as to periodically pass through nip 52 to remove particles adhering to blade 36 in the region of nip 52. In this way, uneven metering is prevented. This insures that the resultant copies do not have streaks thereon. An exemplary development apparatus of the type described herein is depicted more fully in U.S. Pat. No. 4,459,009 issued in 1984 to Hays et al., the relevant portions thereof being hereby incorporated into the present invention. The detailed structure of various embodiments of cleaning device 38 will be described hereinafter with reference to FIGS. 3 through 5, inclusive.

Figure 3:
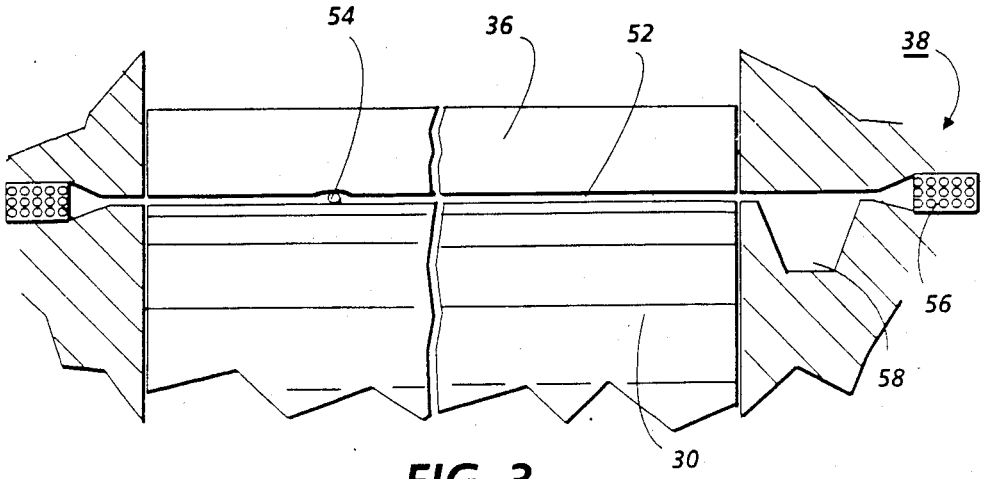
FIG. 3 illustrates one embodiment of the cleaning device used in the FIG. 2 development system.

Referring now to FIG. 3, there is shown one embodiment of cleaning device 38. As depicted thereat, cleaning device 38 includes a string or monofilament fiber 54 which the machine operator can manually pull through nip 52, defined by the contact zone between blade 36 and donor roller 30, to remove foreign matter or particles adhering to blade 36. String 54 is stored in the form of a coil 56 wound around the metering area. When the metering area requires cleaning, the operator pulls out a length of string 54 corresponding to one turn of the coil. The string moves through the charging nip pushing any debris into a small retention space 58 located on one side of the developer housing. Coil 56 is held in place by a low strength adhesive. The adhesive bonding is stronger in one area and represents a natural stop so that the operator can distinguish the end of the loop of the cleaning cycle. The string pulled out is placed in a molded channel and the excess cut by a V-shaped blade. During the next cleaning action, the operator takes the string from the channel, pulls one turn out, and while placing it back in the channel, cuts the excess string. Elastic constriction cleans the string before it exits outside the developer housing. Thus, it is seen that string 54 moves the length of charging blade 36 in nip 52 to remove any debris adhering to blade 36. The debris, in turn, is advanced to receptacle or refuse collector 58 which is a retention space or aperture in the seal of the developer housing.

Figure 4:
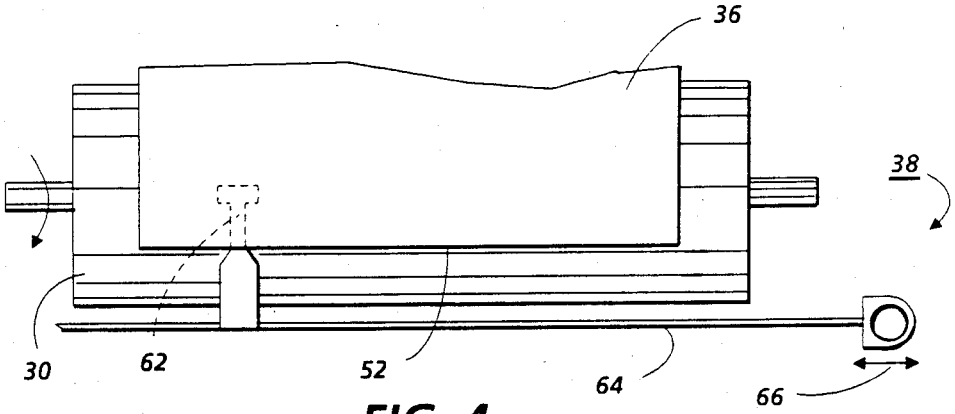
FIG. 4 illustrates another embodiment of the cleaning device used in the FIG. 2 development system.

Another embodiment of cleaning device 38 is shown in FIG. 4. As shown thereat, a plastic or metal strip or blade 62 normally located at one side of the developer housing, in the seal region, is moved between blade 36 and donor roller 30 in nip 52. Strip 62 is mounted on handle 64. In order to periodically clean residual particles and debris on blade 36, the operator grasps handle 64 and pulls it in the direction of arrow 66. In this way, strip 62 moves between blade 36 and roll 30 in nip 52 to sweep any debris and particles adhering to blade 36 into a debris collection space located in the seal of the developer housing on one side thereof. As the operator moves handle 64 in the direction of arrow 66, strip 62 moves across the entire length of blade 36 to remove any debris or particles collected thereon. Thus, the operator pulls handle 64 and thereafter pushes handle 64 in the opposite direction. In this way, strip 62 makes two passes along the edge of blade 36 in nip 52. This type of cleaning action is manually controlled. Alternatively, the cleaning action may be automatic without any manual intervention. An automatic cleaning device is shown in FIG. 5.

Figure 5:
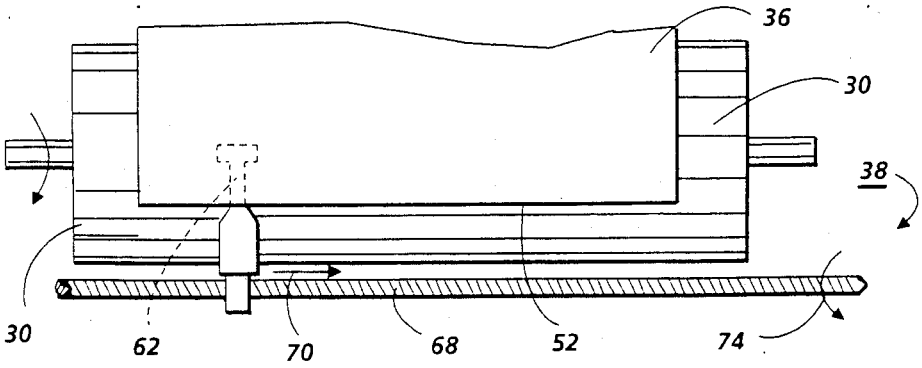
FIG. 5 shows still another embodiment of the cleaning device used in the FIG. 2 development apparatus.

As shown in FIG. 5, a plastic or metal strip or blade 62 is interposed between charging blade 36 and roll 30 in nip 52. Strip 62 is mounted on a slider which, in turn, is mounted movably on led screw 68. Lead screw 68 is connected to a motor (not shown) which is adapted to be periodically actuated. For example, the motor may be actuated automatically by the machine logic after every two thousand copies. Actuation of the motor rotates lead screw 68 in the directionof arrow 74 so as to move strip 62 from one side of the developer housing to the other side thereof in the direction of arrow 70. As strip 62 moves from one side of the developer housing to the other side thereof, it traverses charging blade 36 in nip 52 to remove any debris or particles adhering thereto. The debris and particles are moved by strip 62 to a debris collection opening in the side of the developer housing or in the seal. In this way, charging blade 36 has any debris or particles adhering thereto removed therefrom every two thousand copies.

In recapitulation, it is clear that the cleaning device of the present invention periodically removes particles and debris from a charging blade in the nip so as to prevent the formation of streaks on the copy sheet. The cleaning device may be a string adapted to be manually moved through the nip defined by the charging blade and donor roll or a plastic or metal strip adapted to be manually or automatically moved through the nip. In either case, the debris or particles adhering to the charging blade are removed therefrom and transported to a collection opening in the side of the developer housing or seal.

It is, therefore, evident that there has been provided in accordance with the present invention, a development system including a cleaning device which satisfies the aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications, and variations that fall within the spirit and broad scope of the appended claims.

I claim:

1. An apparatus for developing a latent image with marking particles, including:

a donor roller for transporting the marking particles to the latent image;

a stationary, flexible plate having the free end portion thereof contacting said donor roller to define a nip therebetween for electrically charging and metering the quantity of marking particles being moved to the latent image by said donor roller; and a flexible cleaning member arranged to move along the free end portion of said plate for periodically cleaning said plate to remove particles adhering thereto.

2. An appartus according to claim 1, wherein said cleaning member includes a flexible string arranged to be moved through the nip to remove particles adhering to said plate.

3. An apparatus according to claim 1, wherein said cleaning member includes a flexible strip adapted to have an edge portion thereof positioned in the nip so that said strip moves along the nip particles are removed from said plate.

4. An apparatus according to claim 3, wherein said cleaning member includes means for automatically moving said strip along the nip after a preselected number of latent images have been developed.

5. An electrophotographic printing machine of the type having an electrostatic latent image recorded on a photoconductive member with the latent image being developed with insulating toner particles to form a toner powder image thereon that is transferred to a copy sheet and permanently fused thereto to form a copy of an original document being reproduced, wherein the improvement includes:

a donor roller for transporting the toner particles to the latent image;

a stationary, flexible plate having the free end portion thereof contacting said donor roller to define a nip therebetween for electrically charging and metering the quantity of toner particles being moved to the latent image by said donor roller; and a flexible cleaning member arranged to move along the free end portion of said plate for periodically cleaning said plate to remove particles adhering thereto.

6. A printing machine according to claim 5, wherein said cleaning member includes a flexible string arranged to be pulled through the nip to remove particles adhering to said plate.

7. A printing machine according to claim 5, wherein said cleaning member includes a flexible strip adapted to have an edge portion thereof positioned in the nip so that as said strip moves along the nip particles are removed from said plate.

8. A printing machine according to claim 7, wherein said cleaning member includes means for automatically moving said strip along the nip after a preselected number of copies have been reproduced.

* * * * *